US007220189B2

(12) United States Patent
Wieland et al.

(10) Patent No.: US 7,220,189 B2
(45) **Date of Patent: *May 22, 2007**

(54) IRON GOLF CLUB

(75) Inventors: Chris J. Wieland, Vista, CA (US); Karl A. Clausen, San Marcos, CA (US); Uday V. Deshmukh, Oceanside, CA (US); Jesse Bolane, Carlsbad, CA (US); Robert R. Lang, Escondido, CA (US); Roger Cleveland, Los Angeles, CA (US); Herbert Reyes, Laguna Niguel, CA (US); Augustin W. Rollinson, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 204 days.

This patent is subject to a terminal disclaimer.

(21) Appl. No.: 10/906,468

(22) Filed: Feb. 22, 2005

(65) Prior Publication Data

US 2005/0130765 A1 Jun. 16, 2005

Related U.S. Application Data

(63) Continuation of application No. 10/605,535, filed on Oct. 6, 2003, now Pat. No. 6,857,973, which is a continuation-in-part of application No. 10/604,520, filed on Jul. 28, 2003, now Pat. No. 6,863,625, which is a continuation-in-part of application No. 10/065,147, filed on Sep. 20, 2002, now Pat. No. 6,769,998.

(51) Int. Cl.
*A63B 53/04* (2006.01)

(52) U.S. Cl. ..... 473/342; 473/349; 473/350

(58) Field of Classification Search ..... 473/324–350, 473/290–292, 305–315

See application file for complete search history.

(56) References Cited

U.S. PATENT DOCUMENTS

| | | | | |
|---|---|---|---|---|
| 4,664,383 | A | 5/1987 | Aizawaet al. | |
| 4,667,963 | A | 5/1987 | Yoneyama | |
| 4,792,139 | A | 12/1988 | Nagasaki et al. | |
| 4,793,616 | A * | 12/1988 | Fernandez | 473/347 |
| 4,798,383 | A | 1/1989 | Nagasaki et al. | |
| 4,848,747 | A | 7/1989 | Fujimura et al. | |
| 4,884,812 | A | 12/1989 | Nagasaki et al. | |
| 4,928,972 | A | 5/1990 | Nakanishi et al. | |
| 4,964,640 | A | 10/1990 | Nakanishi et al. | |
| 5,120,062 | A | 6/1992 | Scheie et al. | |
| 5,190,290 | A | 3/1993 | Take | |
| 5,228,694 | A | 7/1993 | Okumoto et al. | |
| D347,254 | S | 5/1994 | Iinuma | |
| 5,326,106 | A | 7/1994 | Meyer | |
| 5,333,872 | A | 8/1994 | Manning et al. | |
| D353,644 | S | 12/1994 | Hirsch et al. | |

(Continued)

*Primary Examiner*—Sebastiano Passaniti
(74) *Attorney, Agent, or Firm*—Michael A. Catania; Elaine H. Lo

(57) ABSTRACT

The iron golf club head (20) of the present invention is preferably composed of three main components: a periphery member 22, a central member 24 and a face plate 26. The periphery member (22) is preferably composed of a high density material such as a nickel-tungsten alloy. The central member (24) is preferably composed of a lightweight, non-metal material. The face plate (26) is preferably composed of a titanium alloy material. The iron golf club head (20) preferably has high moments of inertia Izz and Ixx.

20 Claims, 6 Drawing Sheets

U.S. PATENT DOCUMENTS

| | | | | |
|---|---|---|---|---|
| 5,375,840 | A | 12/1994 | Hirsch et al. | |
| D354,786 | S | 1/1995 | Manning et al. | |
| 5,411,264 | A | 5/1995 | Oku | |
| 5,423,546 | A | 6/1995 | Manning et al. | |
| 5,447,311 | A * | 9/1995 | Viollaz et al. | 473/342 |
| 5,472,201 | A | 12/1995 | Aizawa et al. | |
| D366,082 | S | 1/1996 | Dekura | |
| 5,497,995 | A * | 3/1996 | Swisshelm | 473/350 |
| D368,756 | S | 4/1996 | Blough et al. | |
| D368,947 | S | 4/1996 | Blough et al. | |
| 5,547,194 | A | 8/1996 | Aizawa et al. | |
| 5,595,552 | A | 1/1997 | Wright et al. | |
| 6,277,326 | B1 | 8/2001 | Deshmukh et al. | |
| D464,387 | S | 10/2002 | Rollinson et al. | |
| D464,693 | S | 10/2002 | Rollinson et al. | |
| D474,822 | S | 5/2003 | Cleveland et al. | |
| 6,743,114 | B2 * | 6/2004 | Best | 473/291 |
| 6,743,117 | B2 * | 6/2004 | Gilbert | 473/332 |
| 6,769,998 | B2 * | 8/2004 | Clausen et al. | 473/342 |
| 6,814,674 | B2 * | 11/2004 | Clausen et al. | 473/342 |
| 6,857,973 | B2 * | 2/2005 | Wieland et al. | 473/342 |
| 6,863,625 | B2 * | 3/2005 | Reyes et al. | 473/342 |
| 6,887,164 | B2 * | 5/2005 | Dewanjee et al. | 473/342 |
| 7,004,853 | B2 * | 2/2006 | Deshmukh | 473/332 |
| 7,144,336 | B2 * | 12/2006 | Reyes et al. | 473/342 |

* cited by examiner

IRON GOLF CLUB

CROSS REFERENCES TO RELATED APPLICATIONS

The present application is a continuation of U.S. patent application Ser. No. 10/605,535, filed on Oct. 6, 2003, now U.S. Pat. No. 6,857,973 which is a continuation-in-part application of U.S. patent application Ser. No. 10/604,520, filed on Jul. 28, 2003, now U.S. Pat. No. 6,863,625 which is a continuation-in-part application of U.S. patent application Ser. No. 10/065,147, filed on Sep. 20, 2002 now U.S. Pat. No. 6,769,998.

BACKGROUND OF THE INVENTION

1. Field of the Invention

The present invention relates to an iron golf club. More specifically, the present invention relates to a multiple material iron golf club.

2. Description of the Related Art

Irons are typically composed of a stainless steel or titanium material, and are typically cast or forged. Most golfers desire that their irons have a large sweet spot for greater forgiveness, a low center of gravity to get the ball in the air, a solid sound, reduced vibrations during impact, and a trim top line for appearance. Unfortunately, these desires are often in conflict with each other as it pertains to an iron.

The use of iron club heads composed of different materials has allowed some prior art irons to achieve some of these desires.

One example is U.S. Pat. No. 5,228,694 to Okumoto et al., which discloses an iron club head composed of a stainless steel sole and hosel, a core composed of a bulk molding compound or the like, a weight composed of a tungsten and polyamide resin, and an outer-shell composed of a fiber-reinforced resin.

Another example is set forth in U.S. Pat. Nos. 4,792,139, 4,798,383, 4,792,139 and 4,884,812, all to Nagasaki et al., which disclose an iron club head composed of stainless steel with a fiber reinforced plastic back plate to allow for weight adjustment and ideal inertia moment adjustment.

Another example is U.S. Pat. No. 4,848,747 to Fujimura et al., which discloses a metal iron club head with a carbon fiber reinforced plastic back plate to increase the sweet spot. A ring is used to fix the position of the back plate.

Another example is set forth in U.S. Pat. Nos. 4,928,972 and 4,964,640 to Nakanishi et al., which disclose an iron club head composed of stainless steel with a fiber reinforcement in a rear recess to provide a dampening means for shock and vibrations, a means for increasing the inertial moment, a means for adjusting the center of gravity and a means for reinforcing the back plate.

Another example is U.S. Pat. No. 5,190,290 to Take, which discloses an iron club head with a metal body, a filling member composed of a light weight material such as a plastic, and a fiber-reinforced resin molded on the metal body and the filling member.

Another example is U.S. Pat. No. 5,411,264 to Oku, which discloses a metal body with a backwardly extended flange and an elastic fiber face plate in order to increase the moment of inertia and minimize head vibrations.

Another example is U.S. Pat. No. 5,472,201 to Aizawa et al., which discloses an iron club head with a body composed of stainless steel, a face member composed of a fiber reinforced resin and a protective layer composed of a metal, in order to provide a deep center of gravity and reduce shocks.

Another example is U.S. Pat. No. 5,326,106 to Meyer, which discloses an iron golf club head with a metal blade portion and hosel composed of a lightweight material such as a fiber reinforced resin.

Another example is U.S. Pat. No. 4,664,383 to Aizawa et al., which discloses an iron golf club head with a metal core covered with multiple layers of a reinforced synthetic resin in order to provide greater ball hitting distance.

Another example is U.S. Pat. No. 4,667,963 to Yoneyama, which discloses an iron golf club head with a metal sole and a filling member composed of a fiber reinforced resins material in order to provide greater hitting distance.

The prior art fails to disclose an iron golf club head that is composed of multiple materials, has a low center of gravity, reduced vibrations, and a greater moment of inertia.

BRIEF SUMMARY OF THE INVENTION

The present invention provides an iron golf club head which has a low center of gravity, a high moment of inertia, reduced vibrations and a solid feel and appearance. The present invention is able to provide these features through use of a multiple material iron club head.

One aspect of the present invention is an iron golf club head composed of a periphery member, a central member and a face plate. The periphery member is composed of a first metal material. The periphery member has a sole wall, a toe wall extending upward from the sole wall at a first end of the sole wall, a hosel extending upward from the sole wall at a second end of the sole wall, and a heel wall extending upward from the sole wall. The central member, which is coupled to the periphery member, is composed of a non-metal material. The central member has a body portion with a forward surface, a rear surface, a sole surface, a top surface, a toe surface, a heel surface. The central member has a cavity formed in the rear surface of the body portion. The face plate is composed of a second metal material, which has a lower density than the first metal material. The face plate is coupled to the periphery member and is disposed over the forward surface of the central member.

Another aspect of the invention is an iron golf club including a periphery member, a central member and a face plate. The periphery member is composed of a first metal material having a density between 8 g/cm$^3$ and 12 g/cm$^3$. The periphery member includes a sole wall, a toe wall, a hosel, a heel wall, and a top wall, the top, sole, heel and toe walls defining an opening. The central member and the face plate are disposed in the opening of the periphery member, with the face plate being disposed over the forward surface of the central member. The face plate has a thickness between 0.040 inch and 0.250 inch.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
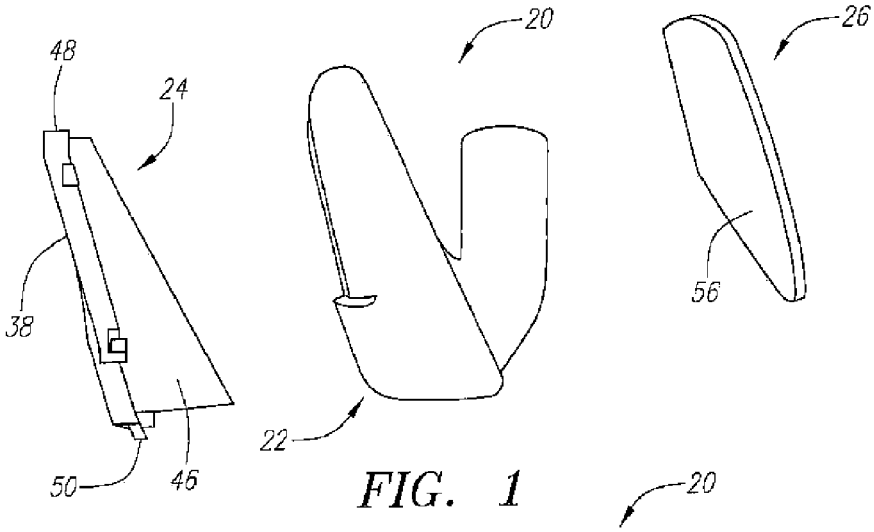
FIG. 1 is an exploded view of an iron club head of a preferred embodiment of the present invention.

As shown in FIGS. 1-8, an iron golf club head in accordance with the present invention is generally designated 20. The club head 20 is preferably composed of three main components: a periphery member 22, a central member 24 and a face plate 26. The club head 20 can range from a 1-iron to a lob-wedge, with the loft angle preferably ranging from fifteen degrees to sixty degrees, and a lie angle preferably ranging from fifty-nine to sixty-five degrees. The three main components are assembled into the club head 20 using a process such as disclosed in co-pending U.S. patent application Ser. No. 10/065,150, filed on Sep. 20, 2002, entitled Method For Manufacturing Iron Golf Club Head, which is hereby incorporated by reference in its entirety.

The periphery member 22 is preferably composed of a material having a density greater than 7.86 grams per centimeter cubed ("g/cm$^3$"). A preferred material is an iron-nickel-tungsten alloy having a density preferably ranging from 8.0 g/cm$^3$ to 12.0 g/cm$^3$, more preferably ranging from 9.0 g/cm$^3$ to 10.5 g/cm$^3$, most preferably 9.3 g/cm$^3$. Another preferred material is a nickel-tungsten alloy disclosed in co-pending U.S. patent application Ser. No. 10/604,518, filed on an even date herewith, entitled High Density Alloy for Improved Mass Properties of an Article, which is hereby incorporated by reference in its entirety. The preferred nickel-tungsten alloy includes at least 50 weight percent nickel, at least 20 weight percent tungsten and at least 20 weight percent chromium and has a density in the range of 9.0 g/cm$^3$ to 10.5 g/cm$^3$. Another alternative material is a stainless steel material. Still another material is disclosed in U.S. Pat. No. 6,277,326, entitled Process for Liquid-Phase Sintering of a Multiple-Component Material, which is hereby incorporated by reference in its entirety. Those skilled in the pertinent art will recognize that still other materials may be used for the periphery member 22 without departing from the scope and spirit of the present invention. A preferred method for forming the periphery member 22 is through investment casting.

The periphery member 22 has a sole wall 28, a toe wall 30, a heel wall 32, a top wall 33, and a hosel 34 with a bore 36 for receiving a shaft. The top wall 33, sole wall 28, toe wall 30 and heel wall 32 define an opening 37 through the periphery member 22. The bore 36 preferably extends through the entire hosel 34 providing a short straight hollow hosel such as disclosed in U.S. Pat. No. 4,995,609, which pertinent parts are hereby incorporated by reference.

Figure 6:
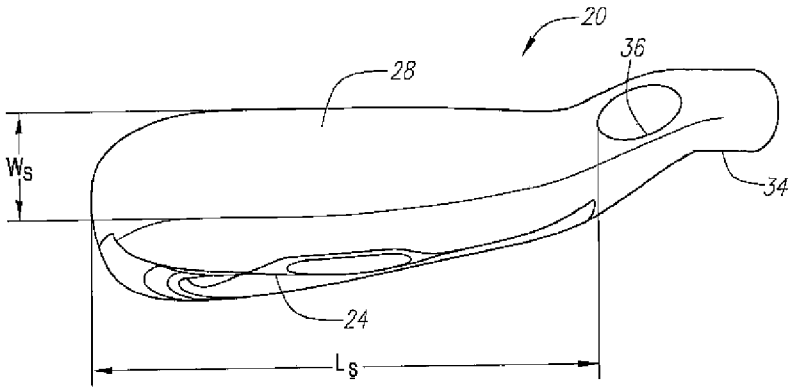
FIG. 6 is a bottom plan view of an iron club head.
Figure 7:
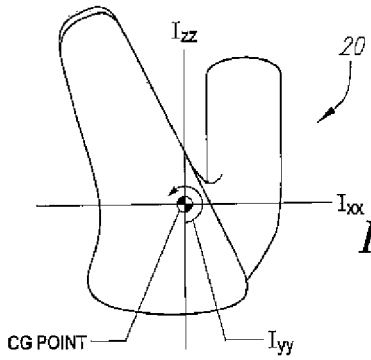
FIG. 7 is a toe side view of an iron club head illustrating the moments of inertia through the center of gravity.
Figure 8:
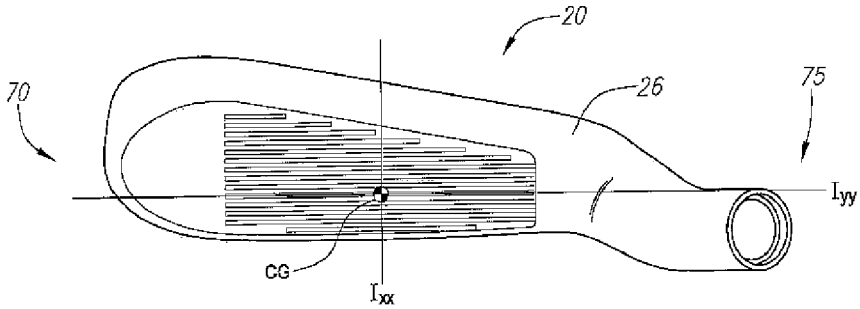
FIG. 8 is a top plan view of an iron club head illustrating the moments of inertia through the center of gravity.

The sole wall 28 preferably has a cambered exterior surface, which contacts the ground during a golf swing. As shown in FIG. 6, the sole wall 28 has a width, "$W_S$", that preferably ranges from 1.00 inch to 1.75 inch, and is most preferably 1.25 inch. The sole wall 28 also has a length, "$L_S$", from a toe end to the beginning of the bore 36, which preferably ranges from 2.5 inches to 3.5 inches, and is most preferably 3.0 inches.

Figure 4:
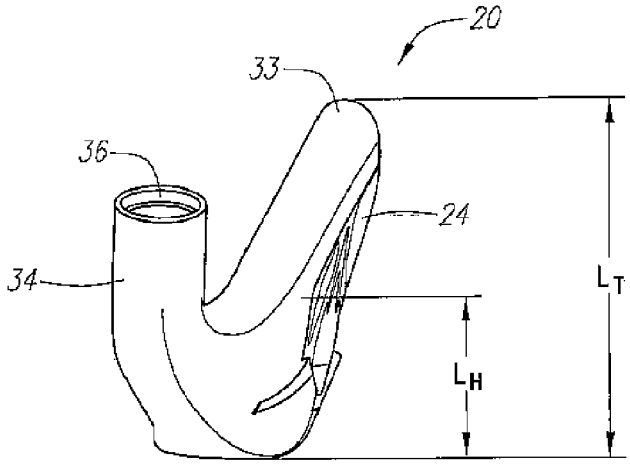
FIG. 4 is a heel side view of an iron club head.
Figure 5:
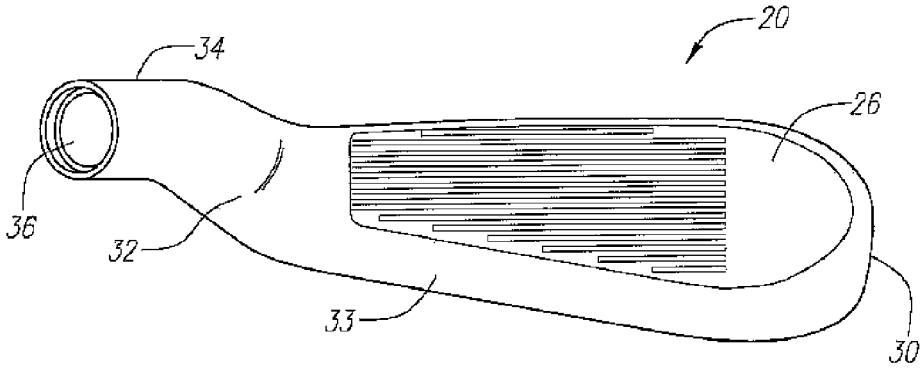
FIG. 5 is a top plan view of an iron club head.

As shown in FIG. 4, the toe wall 30 preferably has a length, "$L_T$", which preferably ranges from 1.5 inches to 2.5 inches, and is most preferably 2.0 inches. The toe wall 30 preferably has a width that tapers from a lower end to an upper end of the toe wall 30.

As shown in FIG. 4, the heel wall 32 preferably has a length, "$L_H$", which preferably ranges from 0.5 inch to 1.5 inches, and is most preferably 1.0 inch. The heel wall 32 preferably has a width that tapers from a lower end to an upper end of the heel wall 32.

In general, the periphery member 22 provides the club head 20 with a greater moment of inertia due to its relatively large mass positioned outward from the center of gravity of the club head 20. Further, mass attributable to the sole wall 28 lowers the center of gravity of the club head 20 to promote a higher trajectory during ball striking thereby creating a more forgiving iron. The periphery member 22 is preferably 15% to 50% of the volume of the club head 20 and preferably 50% to 80% of the mass of the club head 20.

The central member 24 is composed of a non-metal material. Preferred materials include bulk molding compounds, sheet molding compounds, thermosetting materials and thermoplastic materials. A preferred bulk molding compound is a resinous material with reinforcement fibers. Such resins include polyesters, vinyl esters and epoxy. Such fibers include carbon fibers, fiberglass, aramid or combinations. A preferred sheet molding compound is similar to the bulk molding compounds, however, in a sheet form. A preferred thermoplastic material is a thermoplastic polyurethane. Other thermoplastic materials include polyesters, polyethylenes, polyamides, polypropylenes, and the like.

The central member 24 is primarily a support for the face plate 26, and thus the central member should be able to withstand impact forces without failure. The central member 24 also reduces vibrations of the golf club head 20 during ball striking. The central member 24 is preferably 25% to 75% of the volume of the club head 20 and preferably 10% to 30% of the mass of the club head 20.

The central member 24 preferably has a body portion 38, a first recess 40, a second recess 41, an interior surface 42, an exterior surface 43, a sole surface 44, a top surface 45, a toe surface 46, and a heel surface 47. The recesses 40 and 41 are formed in the exterior surface 43 of the body portion 38 and may have any of a number of suitable configurations.

The body portion 38 preferably tapers upward from the sole surface 44. The body portion 38 also has a perimeter 48 and a perimeter interior surface 49.

On the perimeter 48 is a plurality of tabs 50 for positioning and retaining the central member 24 within the periphery member 22. Each of the plurality of tabs 50 is preferably curved portion. The curved portion engages with the interior surface of the periphery member 22. Each of the plurality of tabs 50 is compressible for engagement of the central member 24 with the periphery member 22, and the plurality of tabs 50 assist with the centering and alignment of the central member 24. An adhesive is filled between the each of the plurality of tabs 50 for securing the central member 24 to the periphery member 22. A more thorough description of the plurality of tabs 50 is disclosed in Helmstetter et al., U.S. Pat. No. 6,238,302 for a Golf Club Head With An Insert Having Integral Tabs, assigned to Callaway Golf Company, and hereby incorporated by reference in its entirety.

A first medallion 71 is preferably placed within the first recess 40 and a second medallion 73 is preferably placed within the second recess 41. The first and second medallions 71 and 73 are preferably utilized for swing weighting of the golf club head 20. The mass each medallion 71 and 73 preferably varies from 0.5 gram to 7 grams.

The face plate 26 is preferably composed of a lightweight material. The lightweight material has a density that is preferably lower than the periphery member material. Such lightweight materials include titanium materials, stainless steel, amorphous metals and the like. Such titanium materials include pure titanium and titanium alloys such as 6-4 titanium alloy, 6-22-22 titanium alloy, 4-2 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. The face plate 26 is preferably manufactured through casting, forging, forming, machining, powdered metal forming, metal-injection-molding, electro-chemical milling, and the like.

The face plate 26 has an interior surface 56, which preferably engages the interior surface 42 of the central member 24 or an adhesive placed on the interior surface 42 of the central member 24, and an exterior surface 54 which preferably has scorelines 57 thereon. The face plate 26 preferably has a thickness that ranges from 0.040 inch to 0.250 inch, more preferably from 0.075 inch to 0.160 inch, and most preferably 0.125 inch.

The club head 20 preferably has a total volume that ranges from 40.0 $cm^3$ to 60.0 $cm^3$, more preferably from 45.0 $cm^3$ to 55.0 $cm^3$, and most preferably 50.8 $cm^3$ for a 5-iron golf club head 20. The club head 20 preferably has a mass that ranges from 235 grams to 300 grams, more preferably from 245 grams to 260 grams for a 5-iron golf club head 20.

The periphery member 22 preferably has a mass that ranges from 100 grams to 240 grams, more preferably from 140 grams to 200 grams, and most preferably 152 grams. The central member 24 preferably has a mass that ranges from 9 grams to 70 grams, more preferably from 15 grams to 50 grams, and most preferably 18 grams.

The face plate 26 preferably has a total volume that ranges from 4.0 $cm^3$ to 8.0 $cm^3$, more preferably from 4.5 $cm^3$ to 6.0 $cm^3$, and most preferably 5.3 $cm^3$. The face plate 26 preferably has a mass that ranges from 15 grams to 50 grams, more preferably from 20 grams to 30 grams, and most preferably 24 grams.

Figure 2A:
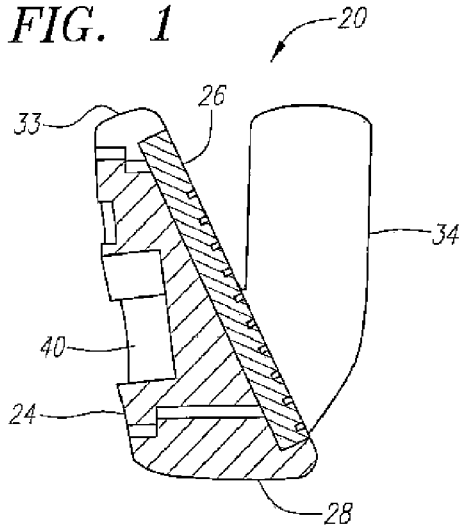
FIG. 2A is a cross-sectional view of the iron golf club head of FIG. 2 along lines A-A.
Figure 2:
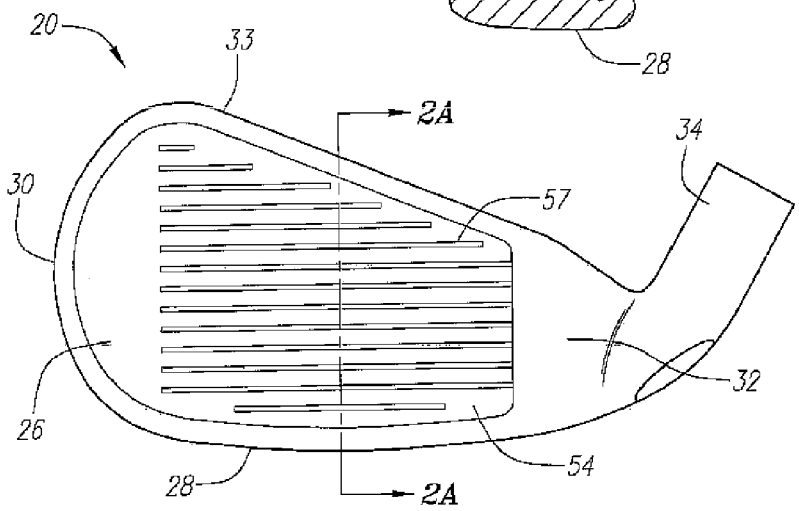
FIG. 2 is a front plan view of an iron club head.
Figure 3:
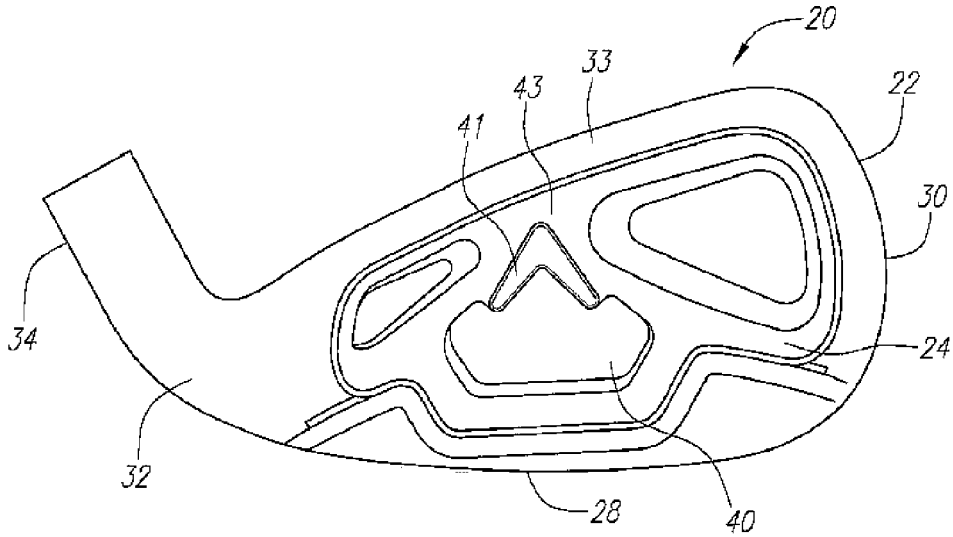
FIG. 3 is a rear plan view of an iron club head.
Figure 9:
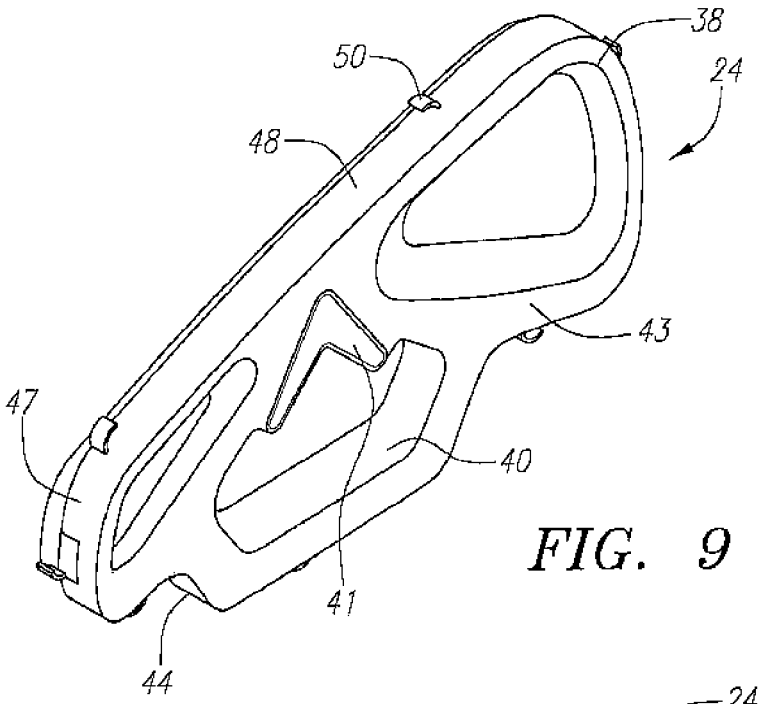
FIG. 9 is isolated perspective view of a preferred embodiment of a central member of a golf club head.
Figure 10:
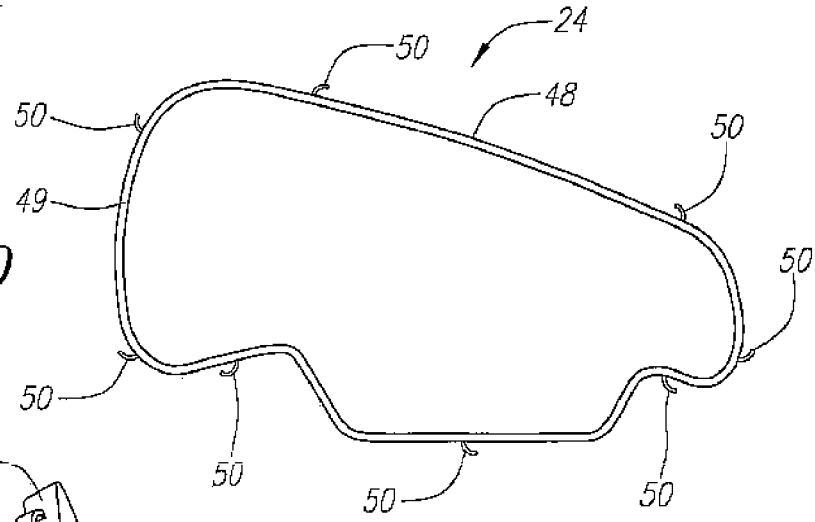
FIG. 10 is a rear plan view of the central member of FIG. 9.
Figure 11:
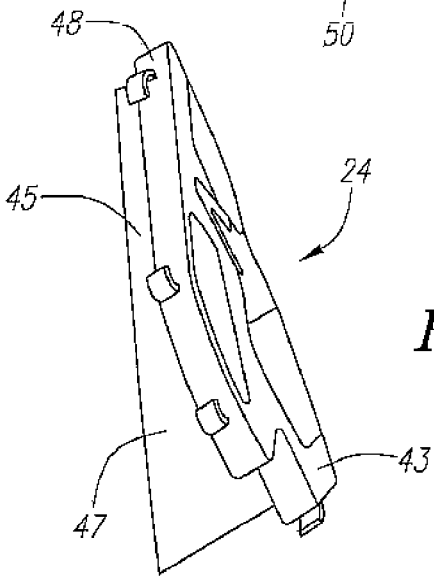
FIG. 11 is a heel side view of the central member of FIG. 9.
Figure 12:
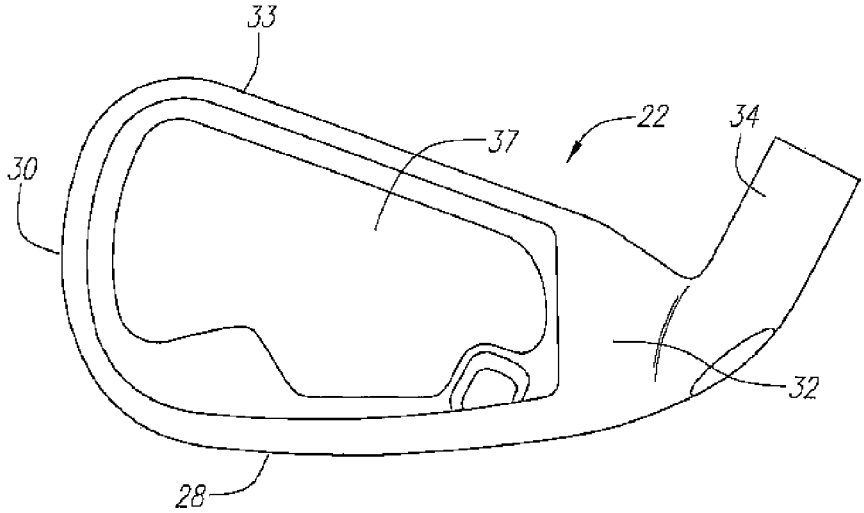
FIG. 12 is an isolated front plan view of a periphery member of a golf club head.
Figure 13:
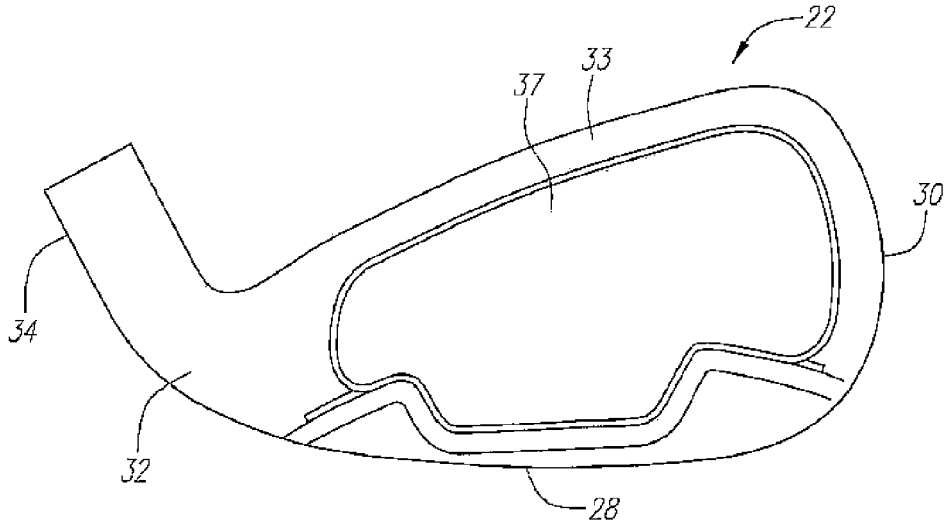
FIG. 13 is a rear plan view of the periphery member of FIG. 12.
Figure 14:
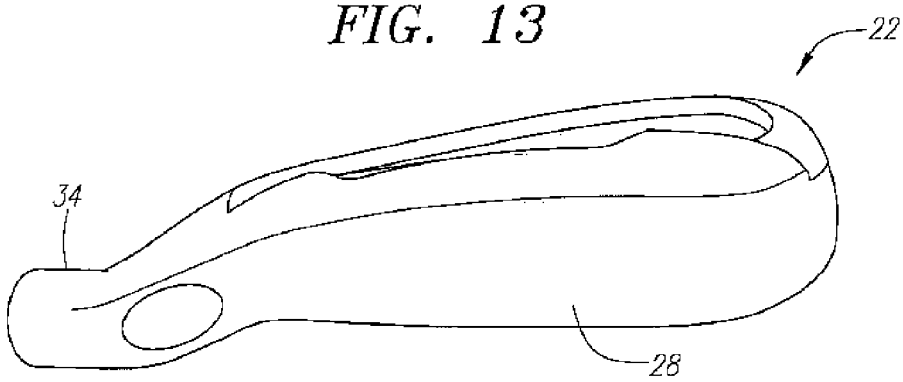
FIG. 14 is a bottom plan view of the periphery member of FIG. 12.
Figure 15:
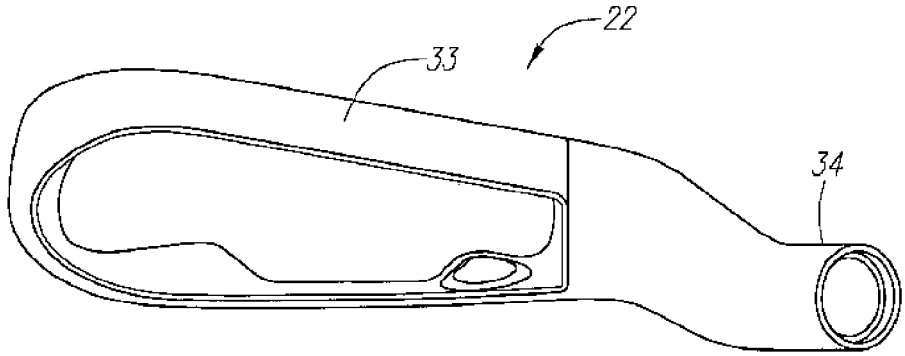
FIG. 15 is a top plan view of the periphery member of FIG. 12.
Figure 16:
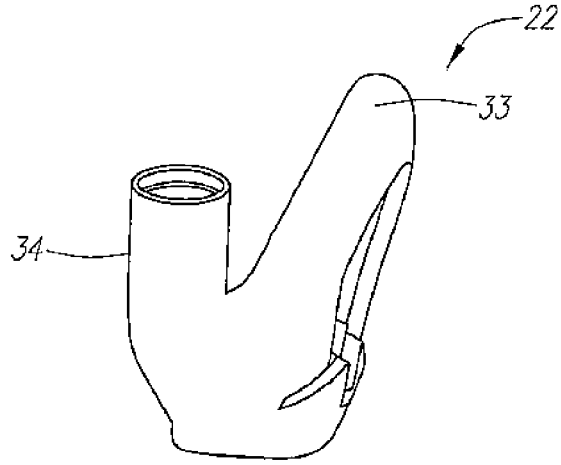
FIG. 16 is a heel side view of the periphery member of FIG. 12.
Figure 17:
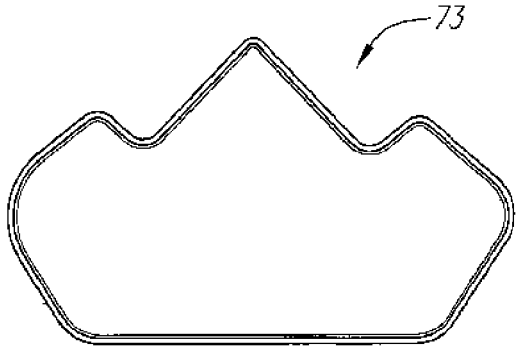
FIG. 17 is a top plan view of a medallion of a golf club head.
Figure 18:
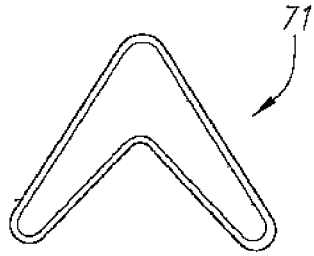
FIG. 18 is a top plan view of a medallion of a golf club head.

FIGS. 9-1 2 illustrate the axes of inertia through the center of gravity of the golf club head 20. The axes of inertia are designated X, Y and Z. The X axis extends from the front of the golf club head 20 through the center of gravity, CG, at the face plate 26 to the rear of the golf club head 20. The Y axis extends from the heel end 75 of the golf club head 20 through the center of gravity, CG, and to the toe end 70 of the golf club head 20. The Z axis extends from the sole wall through the center of gravity, CG, and to the top line 80.

As defined in *Golf Club Design, Fitting, Alteration & Repair,* 4th Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 20 are preferably measured using a test frame ($X^T$, $Y^T$, $Z^T$), and then transformed to a head frame ($X^H$, $Y^H$, $Z^H$). The center of gravity of a golf club head 20 may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z-axis for the golf club head 20 preferably ranges from 2200 g-$cm^2$ to 3000 g-$cm^2$, more preferably from 2400 g-$cm^2$ to 2700 g-$cm^2$, and most preferably from 2472 g-$cm^2$ to 2617 g-$cm^2$. The moment of inertia, Iyy, about the Y-axis for the golf club head 20 preferably ranges from 400 g-$cm^2$ to 700 g-$cm^2$, more preferably from 500 g-$cm^2$ to 600 g-$cm^2$, and most preferably from 530 g-$cm^2$ to 560 g-$cm^2$. The moment of inertia, Ixx, about the X-axis for the golf club head 20 preferably ranges from 2450 g-$cm^2$ to 3200 g-$cm^2$, more preferably from 2500 g-$cm^2$ to 2900 g-$cm^2$, and most preferably from 2650 g-$cm^2$ to 2870 g-$cm^2$.

In general, the products of inertia, Iyz, Ixz and Ixy for the golf club head 20 preferably have an absolute value below 100 g-$cm^2$ for at least one and preferably two of the products of inertia Iyz, Ixz and Ixy. Products of inertia for a golf club head are disclosed in U.S. Pat. No. 6,547,676, entitled Golf Club Head That Optimizes Products Of Inertia, assigned to Callaway Golf Company, and hereby incorporated by reference in its entirety.

For comparison, the new BIG BERTHA® 5-iron from Callaway Golf Company has a moment of inertia, Izz, of 2158 g-$cm^2$, a moment of inertia, Iyy, of 585 g-$cm^2$, and a moment of inertia, Ixx, of 2407 g-$cm^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. An iron golf club head comprising;

a periphery member composed of a first metal material, the periphery member having a sole wall, a toe wall extending upward from the sole wall at a first end of the sole wall, a hosel extending upward from the sole wall at a second end of the sole wall, a heel wall extending upward from the sole wall, and a top wall extending from an upper end of the toe wall to an upper end of the heel wall, the top, sole, heel and toe walls of the periphery member defining an opening;

a central member disposed in the opening of the periphery member, the central member being composed of a non-metal material; and a face plate composed of a second metal material, the second metal material having a lower density than the first metal material, the face plate being coupled to the periphery member and disposed over the central member.

2. The iron golf club head according to claim 1 wherein the first metal material has a density between 8 g/cm$^3$ and 12 g/cm$^3$.

3. The iron golf club head according to claim 1 wherein the first metal material comprises a nickel-tungsten alloy including at least approximately 50 weight percent nickel and at least approximately 20 weight percent tungsten.

4. The iron golf club head according to claim 3 wherein the nickel-tungsten alloy further comprises at least 20 weight percent chromium.

5. The iron golf club head according to claim 1 wherein the second metal material comprises a titanium alloy.

6. The iron golf club head according to claim 5 wherein the face plate has a thickness ranging from 0.040 inch to 0.250 inch.

7. The iron golf club head according to claim 1 wherein the central member is composed of a thermoplastic material.

8. The iron golf club head according to claim 1 wherein the iron golf club head has a moment of inertia Ixx through the center of gravity of at least 2600 g-cm$^2$ and a moment of inertia Izz through the center of gravity of at least 2400 g-cm$^2$.

9. The iron golf club head according to claim 1 wherein the periphery member has a volume percentage of the golf club head ranging from 15% to 50%, and a mass percentage of the golf club head ranging from 50% to 80%.

10. The iron golf club head according to claim 1 wherein the central member has a volume percentage of the golf club head ranging from 25% to 75%, and a mass percentage of the golf club head ranging from 10% to 30%.

11. An iron golf club head comprising:

a periphery member composed of a first metal material having a density between 8 g/cm$^3$ and 12 g/cm$^3$, the periphery member having a sole wall, a toe wall extending upward from the sole wall at a first end of the sole wall, a hosel extending upward from the sole wall at a second end of the sole wall, a heel wall extending upward from the sole wall, and a top wall extending from an upper end of the toe wall to an upper end of the heel wall, the top, sole, heel and toe walls of the periphery member defining an opening;

a central member disposed in the opening of the periphery member, the central member being composed of a non-metal material; and a face plate composed of a second metal material, the second metal material having a lower density than the first metal material, the face plate being mounted in the opening of the periphery member and disposed over the central member, the face plate having a thickness between 0.040 inch and 0.250 inch.

12. The iron golf club head according to claim 11 wherein the first metal material comprises a nickel-tungsten alloy including at least approximately 50 weight percent nickel and at least approximately 20 weight percent tungsten.

13. The iron golf club head according to claim 12 wherein the nickel-tungsten alloy further includes at least 20 weight percent chromium.

14. The iron golf club head according to claim 11 wherein the second metal material comprises a titanium alloy.

15. The iron golf club head according to claim 11 wherein the club head has a moment of inertia Ixx through the center of gravity of at least 2600 g-cm$^2$ and a moment of inertia Izz through the center of gravity of at least 2400 g-cm$^2$.

16. An iron golf club head comprising:

a periphery member composed of a first metal material having a density between 8 g/cm$^3$ and 12 g/cm$^3$, the periphery member having a sole wall, a toe wall extending upward from the sole wall at a first end of the sole wall, a hosel extending upward from the sole wall at a second end of the sole wall, a heel wall extending upward from the sole wall, and a top wall extending from an upper end of the toe wall to an upper end of the heel wall, the top, sole, heel and toe walls of the periphery member defining an opening, the periphery member has a volume percentage of the golf club head ranging from 15% to 50%, and a mass percentage of the golf club head ranging from 50% to 80%;

a central member disposed in the opening of the periphery member, the central member being composed of a non-metal material, the central member has a volume percentage of the golf club head ranging from 25% to 75%, and a mass percentage of the golf club head ranging from 10% to 30%.; and a face plate composed of a second metal material, the second metal material having a lower density than the first metal material, the face plate being mounted in the opening of the periphery member and disposed over the central member.

17. An iron golf club head comprising:

a periphery member composed of a first metal material having a density between 8 g/cm$^3$ and 12 g/cm$^3$, the periphery member having a sole wall, a toe wall extending upward from the sole wall at a first end of the sole wall, a hosel extending upward from the sole wall at a second end of the sole wall, a heel wall extending upward from the sole wall, and a top wall extending from an upper end of the toe wall to an upper end of the heel wall, the top, sole, heel and toe walls of the periphery member defining an opening, the periphery member having a mass that ranges from 100 grams to 240 grams;

a central member disposed in the opening of the periphery member, the central member being composed of a non-metal material, the central member having a mass that ranges from 9 grams to 70 grams; and a face plate composed of a second metal material, the second metal material having a lower density than the first metal material, the face plate being mounted in the opening of the periphery member and disposed over the central member, the face plate having a mass that ranges from 15 grams to 50 grams;

wherein the iron golf club head has a mass that ranges from 235 grams to 300 grams.

18. An iron golf club head comprising:

a periphery member having a sole wall, a toe wall extending upward from the sole wall at a first end of the sole wall, a hosel extending upward from the sole wall at a second end of the sole wall, a heel wall extending upward from the sole wall, and a top wall extending from an upper end of the toe wall to an upper end of the heel wall, the top, sole, heel and toe walls of the periphery member defining an opening;

a central member disposed in the opening of the periphery member, the central member being composed of a non-metal material and having a body portion with a perimeter, an interior surface, an exterior surface, a sole surface, a top surface, a toe surface, and a heel surface, the central member having at least one recess formed in the exterior surface of the body portion, the perimeter having a plurality of tabs projecting outward, the tabs engaging an interior surface of the periphery member; and a face plate composed of a titanium alloy, the face plate being mounted in the opening of the periphery member and disposed over the forward surface of the central member.

19. The iron golf club head according to claim 18 wherein the club head has a moment of inertia Izz through the center of gravity of at least 2400 g-cm$^2$ and a moment of inertia Ixx through the center of gravity of at least 2600 g-cm$^2$.

20. An iron golf club head comprising:

a periphery member composed of a first metal material having a density between 8 g/cm$^3$ and 12 g/cm$^3$, the periphery member having a sole wall, a toe wall extending upward from the sole wall at a first end of the sole wall, a hosel extending upward from the sole wall at a second end of the sole wall, a heel wall extending upward from the sole wall, and a top wall extending from an upper end of the toe wall to an upper end of the heel wall, the top, sole, heel and toe walls of the periphery member defining an opening, the periphery member has a volume percentage of the golf club head ranging from 15% to 50%;

a central member disposed in the opening of the periphery member, the central member being composed of a non-metal material, the central member has a volume percentage of the golf club head ranging from 25% to 75%; and a face plate composed of a second metal material, the second metal material having a lower density than the first metal material, the face plate being mounted in the opening of the periphery member and disposed over the central member;

wherein the iron golf club head has a total volume that ranges from 40.0 cm$^3$ to 60.0 cm$^3$.

* * * * *